US010202739B2

(12) United States Patent
Subrahmanyam

(10) Patent No.: US 10,202,739 B2
(45) Date of Patent: Feb. 12, 2019

(54) SYSTEM AND METHOD THEREOF FOR OFF SHORE MINING

(71) Applicant: DORIS MINERAL RESOURCES PRIVATE LIMITED, Hyderabad (IN)

(72) Inventor: Ayyalasomayajula Varaha Subrahmanyam, Hyderabad (IN)

(73) Assignee: DORIS MINERAL RESOURCES PRIVATE LIMITED, Hyderabad (IN)

( * ) Notice: Subject to any disclaimer, the term of this patent is extended or adjusted under 35 U.S.C. 154(b) by 0 days.

(21) Appl. No.: 16/005,025

(22) Filed: Jun. 11, 2018

(65) Prior Publication Data

US 2018/0291588 A1 Oct. 11, 2018

Related U.S. Application Data

(63) Continuation of application No. 15/756,795, filed as application No. PCT/IN2017/050590 on Dec. 12, 2017.

(51) Int. Cl.
*E02F 7/00* (2006.01)
*E02F 7/02* (2006.01)
(Continued)

(52) U.S. Cl.
CPC ..... *E02F 7/023* (2013.01); *E02F 3/9256* (2013.01); *E02F 5/006* (2013.01); *E02F 7/005* (2013.01)

(58) Field of Classification Search
CPC ..... B01D 29/01; B01D 36/02; B01D 37/00; B03B 7/00; B03B 5/623; B03B 5/56; B09C 1/02; B09C 1/08; C02F 1/52; C02F 1/72; E21C 50/00; E01C 1/40; E02B 15/046; E02B 15/048; E02F 3/90; E02F 3/9231; E02F 3/925; E02F 3/062; E02F 3/88; E02F 3/8841; E02F 3/905; E02F 3/92; E02F 3/9287; E02F 3/885; E02F 7/04; E02F 9/06; E02F 7/023; E02F 7/005; E02F 3/9256; E02F 5/006
(Continued)

(56) References Cited

U.S. PATENT DOCUMENTS 3,620,572 A * 11/1971 Krutein ..... E02F 3/88 299/8
3,971,593 A * 7/1976 Porte ..... E21C 50/00 299/8

(Continued)

*Primary Examiner* — Robert E Pezzuto
(74) *Attorney, Agent, or Firm* — Ohlandt, Greeley, Ruggiero & Perle, LLP

(57) ABSTRACT

A system and method of off shore mining for retrieval and extraction of heavy mineral concentrate from placer deposits or other suitable materials. The system comprises a dredge vessel and a barge, coupled in conjunction to the dredge vessel. The dredge vessel having thereon a dredging unit, at least one gravity separator and spiral separators for procurement of total heavy minerals from dredged sediment and debris. The barge is configured to acquire and process the total heavy minerals, wherein the barge has thereon at least one magnetic separator, electro-magnetic separators, and density separators for separation of desired minerals based on their physical properties. The system further comprises at least one discharge conduit for tailing of wastes, leftover after extraction and separation of desired minerals, back into water bodies.

9 Claims, 1 Drawing Sheet

(51) Int. Cl.
*E02F 3/92* (2006.01)
*E02F 5/00* (2006.01)

(58) Field of Classification Search
USPC ..... 37/195, 313, 314, 319, 329, 330, 340, 37/317; 210/710, 721, 727, 754, 758, 210/705, 767; 175/5; 299/8, 9; 417/61, 417/77
See application file for complete search history.

(56) References Cited

U.S. PATENT DOCUMENTS 4,053,181 A * 10/1977 Saito ..... E02F 3/88 299/9
4,398,361 A * 8/1983 Amann ..... E02F 3/88 175/5
5,183,579 A * 2/1993 Eller ..... E02B 15/046 210/776
5,255,787 A * 10/1993 Sims ..... B09C 1/02 209/158
5,575,921 A * 11/1996 Askin ..... C02F 11/123 210/710
7,264,734 B2 * 9/2007 Kelly ..... B09C 1/02 210/710

* cited by examiner

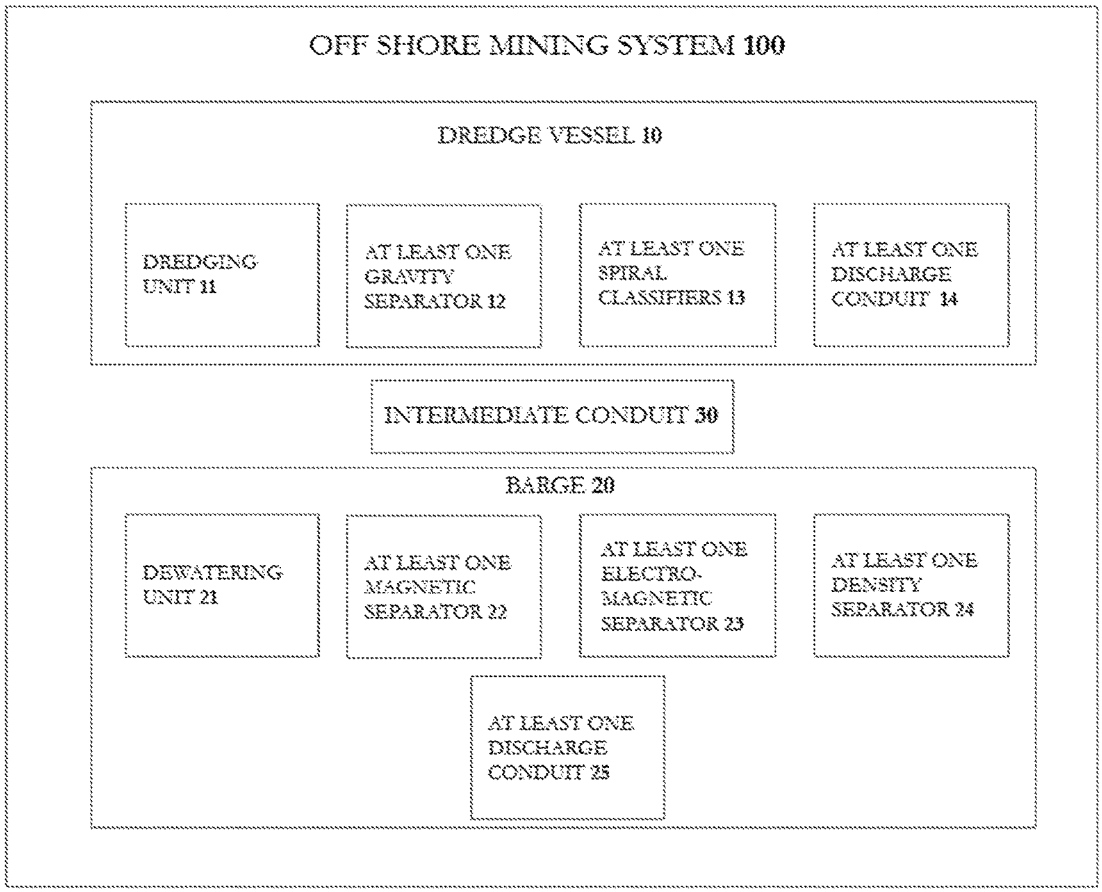
OFF SHORE MINING SYSTEM 100
DREDGE VESSEL 10
DREDGING UNIT 11
AT LEAST ONE GRAVITY SEPARATOR 12
AT LEAST ONE SPIRAL CLASSIFIERS 13
AT LEAST ONE DISCHARGE CONDUIT 14
INTERMEDIATE CONDUIT 30
BARGE 20
DEWATERING UNIT 21
AT LEAST ONE MAGNETIC SEPARATOR 22
AT LEAST ONE ELECTRO-MAGNETIC SEPARATOR 23
AT LEAST ONE DENSITY SEPARATOR 24
AT LEAST ONE DISCHARGE CONDUIT 25

SYSTEM AND METHOD THEREOF FOR OFF SHORE MINING

RELATED APPLICATIONS

The present application is a Continuation Application of U.S. patent application Ser. No. 15/756,795, filed on Mar. 1, 2018 and claims the benefit of International Application No. PCT/IN2017/050590, filed on Dec. 12, 2017, which claims priority to Indian Patent Application No. 201641043326, filed on Dec. 19, 2016, all of which are herein incorporated by reference in their entireties.

BACKGROUND

1. Field of the Disclosure

The present disclosure generally relates to the field of deep sea mining. Particularly, but not exclusively, the present disclosure relates to a system and method of off shore mining for retrieval and extraction of heavy mineral concentrate from placer deposits or other suitable materials.

2. Discussion of the Background Art

Advancement in technology and rapidly progressing industrialization in the current modern world has spurred an upsurge in usage of minerals and metals. Increasing world demand for minerals mandates requisite of new sources of high-quality reserves of heavy minerals concentrate (HMC) which contains metals, minerals and precious stones including gold, diamond, magnetite, rutile, ilmenite, zircon and like. HMC is currently being dredged from continental shelves of global sea floor having placer deposits to cater the increasing world demand for minerals. Placer deposit is a natural concentration of heavy minerals caused by the effect of gravity and weathering processes. Thus, the heavy minerals become concentrated in stream, beach, and lag (residual) gravels and constitute workable ore deposits.

The continental shelves being dredged may constitutes only a very small fraction of HMC from the material recovered from the sea-bed. In generally, the material recovered from the sea-bed is transport to an on-shore processing plant for retrieval and extraction of HMC from the material recovered from the sea-bed. This method is considerably very uneconomical due to increase in cost arising from supply and maintenance of mining and transportation equipment. Moreover, in on shore processing plant, large volumes of wastes like sand, gravel and silt are separated after retrieval and extraction of HMC. With the increasing environmental and pollutions control norms, disposal of these wastes is stipulated and screened to minimize disruption of landscapes, this in turn add a significant cost for the operation. Conventionally, various off-shore techniques have been proposed in order to obtain HMC by undertaking primary separation of material recovered from the sea-bed, considering the fact that waste disposal may be easier and therefore cheaper than on land. Although greater care must be exercised to ensure that waste is not deposited on unworked reserves on the sea-bed. Furthermore, these conventional techniques don't provide a system and method which accomplishes the complete retrieval and extraction of heavy mineral concentrate from material recovered from the sea-bed. The conventional off-shore techniques have limitation with respect to production capacities, higher production costs. Also, there is no significant cost difference in comparative cost between on-shore and off-shore techniques except in special circumstances such as distance from a shore base, environmental factors and like.

The present disclosure is directed to mitigate the above stated problems or other similar problems associated with the prior art.

SUMMARY

One or more shortcomings of the existing methods is overcome by a system and method thereof for off shore mining as claimed in the present disclosure.

Additional features and advantages are realized through the techniques of the present disclosure. Other embodiments and aspects of the disclosure are described in detail herein and are considered a part of the claimed disclosure.

In a non-limiting embodiment of the present disclosure, an off-shore mining system comprises a dredge vessel and a barge. The dredge vessel having thereon a dredging unit adapted for excavate of water bodies and procurement of sediment and debris, at least one gravity separator adapted for separation and exclusion of oversized particles from sediments and debris. Further the dredge vessel comprises of at least one spiral classifier coupled to at least one gravity separator wherein at least one spiral classifier is configured to receive finer particles of sediments and debris to extract total heavy minerals and at least one discharge conduit for tailing of wastes, leftover after extracting total heavy minerals, back into water bodies. The barge is operably coupled in conjunction to the dredge vessel, configured to acquire and process the total heavy minerals, wherein the barge has thereon a dewatering unit configured to expel water absorbed by the total heavy minerals, at least one magnetic separator for separation of desired minerals from total heavy minerals based on magnetic properties of the minerals, at least one electro-magnetic separator for separation of desired minerals from total heavy minerals based on electro-magnetic properties of the minerals and at least one density separator for further separation of desired mineral from total heavy minerals based on density of minerals. Furthermore, the barge comprises of at least one discharge conduit for tailing of wastes, leftover after extraction and separation of desired minerals, back into water bodies.

In another non-limiting embodiment of the present disclosure, a method for off shore mining comprising the steps of dredging and procuring sediments and debris from water bodies, excluding oversized particles and obtaining of finer particles from sediments and debris by gravity separators, extracting total heavy minerals from finer particles of sediments and debris by spiral classifiers. The method further comprises the steps of dewatering the total heavy minerals to expel water absorbed by the total heavy minerals and separation of desired minerals from total heavy minerals based on at least one predetermined properties selected from a group comprising magnetic properties, electro-magnetic properties, and density. Furthermore, the method comprises the step of tailing of wastes, leftover after extraction and separation of desired minerals, back into water bodies.

It is to be understood that the aspects and embodiments of the disclosure described above may be used in any combination with each other. Several of the aspects and embodiments may be combined together to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The novel features and characteristic of the disclosure are set forth in the appended claims. The disclosure itself, however, as well as a preferred mode of use, further objectives and advantages thereof, will best be understood by reference to the following detailed description of an illustrative embodiment when read in conjunction with the accompanying FIGURES. One or more embodiments are now described, by way of example only, with reference to the accompanying FIGURE wherein like reference numerals represent like elements and in which:

FIG. 1 illustrates a schematic block diagram of off shore mining system in accordance with an embodiment of the present disclosure.

The FIGURES depict embodiments of the disclosure for purposes of illustration only. One skilled in the art will readily recognize from the following description that alternative embodiments of the system and methods illustrated herein may be employed without departing from the principles of the disclosure described herein.

DETAILED DESCRIPTION OF THE PREFERRED EMBODIMENT

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the forms disclosed, but on the contrary, the disclosure is to cover all modifications, equivalents, and alternative falling within the spirit and the scope of the disclosure.

The terms "comprises", "comprising", or any other variations thereof, are intended to cover a non-exclusive inclusion, such that a system, device or method that comprises a list of components or steps does not include only those components or steps but may include other components or steps not expressly listed or inherent to such system or device or method. In other words, one or more elements in a system or apparatus proceeded by "comprises . . . a" does not, without more constraints, preclude the existence of other elements or additional elements in the system or apparatus.

Embodiments of the present disclosure are related to an off shore mining system (100). FIG. 1 illustrates a block diagram of off shore mining system (100). The dredge vessel (10) having thereon a dredging unit (11), at least one gravity separator (12), and at least one spiral classifiers (13).

The dredging unit (11) is adapted to perform excavation of a bed or body of water bodies (lakes, rivers, harbours, and like) for procurement of sediment and debris. The dredging unit (11) is substantially a mechanical dredger or a hydraulic dredger or a hydrodynamic dredger, such as a bucket wheel dredger, cutter suction dredger and like. The bucket wheel dredger, employs a plurality of buckets on a revolving chain to dig, scope and remove large quantities of sediment and debris from the bed of water bodies below a plane of movement of the bucket wheel dredger. The cutter suction dredger is equipped with a rotating cutter head, which can cut hard soil or rock, existing in the bed of the water bodies, into fragments. The cutter head is a rotating mechanical device, mounted in front of the suction head and rotating along the axis of the suction pipe. The fragment of sediment and debris thus produced is then sucked in by dredge pumps. Cutter suction dredger can be configured cut the soil according to a pre-set profile.

The gravity separators (12) are coupled to the dredging unit (11), wherein the gravity separators (12) are adapted for separation and exclusion of oversized particles from sediments and debris obtained by the dredging unit (11). The gravity separator (12) is operate by the principle of separation based in difference in size and shape of the particles of sediments and debris. Thus, a finer particle of sediments and debris are obtained by gravity separation (12) of the sediments and debris obtained by the dredging unit (11). The gravity separator (12) is substantially a vibrating screen or a rotary sieve and like.

The spiral classifier (13) is coupled to at least one gravity separator (12), wherein the spiral classifier (13) are configured to receive finer particles of sediment and debris to obtained total heavy minerals. The spiral classifier (13) segregate total heavy minerals and lightweight waste particles, such as sand and silt, from the finer particles of sediment and debris. The segregation is based on the datum that the waste particles have comparatively less specific gravity in comparison with specific gravity of the total heavy minerals. The spiral classifier (13) receive the finer particles of sediment and debris and pass them through a spiral. As the particles of sediment and debris travels down the spiral, the total heavy minerals are segregated from the waste particles.

The dredge vessel (10) further comprises of at least one discharge conduit (14) coupled to at least one spiral classifier (13) for tailing of wastes, leftover after extracting total heavy minerals, back into water bodies.

The barge (20) is a floating vessel which is operably coupled in conjunction accompanying the dredge vessel (10). The barge (20) is configured to acquire and process the total heavy minerals obtained by the dredge vessel (10). The barge (20) has thereon a dewatering unit (21), at least one magnetic separator (22), at least one electro-magnetic separator (23), and at least one density separator (24). The dewatering unit (21) is configured to expel water absorbed by the total heavy mineral. The dewatering unit (21) can accomplish removal of water from the total heavy minerals by sun drying or application of ovens and other similar heating or dehydrating equipment. The magnetic separator (22) is an equipment for selectively retaining magnetic materials, so as to separate them from material fed into the equipment. The magnetic separator (22) is employed for separation of desired minerals from total heavy minerals based on magnetic properties of the minerals. Similarly, the electro-magnetic separator (23) is an equipment for selectively retaining electro-magnetic materials, so as to separate them from material fed into the equipment. The electro-magnetic separator (23) is employed for separation of desired minerals from total heavy minerals based on electrical properties of the minerals. The density separator (24) is a device to classify, separate or sort particles in a fluid (air or water) suspension based on the ratio of their centripetal force to fluid resistance. The density separators (24) are substantially a hydro-sizer or a cyclonic separator or an air/liquid density separator and like.

The barge (20) further includes at least one discharge conduit (25) for tailing of wastes, leftover after extraction and separation of desired minerals, back into water bodies.

In an embodiment, the dewatering unit (21), magnetic separators (22), electro-magnetic separators (23), and density separators (24) included in the barge (20) can be arranged and configured in any sequence based on the requirement of user.

In an embodiment, the off shore mining system (100) further comprises of at least one intermediate conduit (30) interconnecting said dredge vessel (10) with the barge (20) for transferring the total heavy minerals by pumps.

In an embodiment, the total heavy minerals can be passed multiple times through the magnetic separators (22), electro-magnetic separators (23), and density separators (24) to achieve complete extraction of desired minerals.

In an embodiment, a method for off shore mining comprising the steps of:

1. dredging and procurement of sediments and debris from water bodies,
2. exclusion of oversized particles and obtaining of finer particles from sediments and debris by gravity separators,
3. extracting total heavy minerals from finer particles of sediments and debris by spiral classifiers,
4. dewatering of total heavy minerals to expel water absorbed by the total heavy minerals,
5. separation of desired minerals from total heavy minerals based on at least one predetermined properties selected from a group comprising magnetic properties, electro-magnetic properties, density and like, and
6. tailing of wastes, leftover after extraction and separation of desired minerals, back into water bodies.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

List of reference numerals:

| Reference Numeral | Particular |
|---|---|
| 100 | |
| 10 | Dredge vessel |
| 11 | Dredging unit |
| 12 | At least one gravity separator |
| 13 | At least one spiral classifier |
| 14 | At least one discharge conduit |
| 20 | Barge |
| 21 | Dewatering unit |
| 22 | At least one magnetic separator |
| 23 | At least one electro-magnetic separator |
| 24 | At least one density separator |
| 25 | At least one discharge conduit |
| 30 | At least one Intermediate conduit |

What is claimed is:

1. An off shore mining system comprising:

a dredge vessel having thereon a dredging unit adapted for excavate of water bodies and procurement of sediment and debris;

at least one gravity separator adapted for separation and exclusion of oversized particles from sediments and debris;

at least one spiral classifier coupled to at least one gravity separator wherein at least one spiral classifier is configured to receive finer particles of sediments and debris to extract total heavy minerals;

at least one discharge conduit for tailing of wastes, leftover after extracting total heavy minerals, back into water bodies;

a barge, operably coupled in conjunction to the dredge vessel, configured to acquire and process the total heavy minerals, wherein the barge has thereon a dewatering unit configured to expel water absorbed by the total heavy minerals;

at least one magnetic separator for separation of desired minerals from total heavy minerals based on magnetic properties of the minerals;

at least one electro-magnetic separator for separation of desired minerals from total heavy minerals based on electro-magnetic properties of the minerals;

at least one density separator for further separation of desired mineral from total heavy minerals based on density of minerals; and at least one discharge conduit for tailing of wastes, leftover after extraction and separation of desired minerals, back into water bodies.

2. The system as claimed in claim 1, wherein the dredging unit is substantially a bucket wheel dredger or a cutter suction dredger.

3. The system as claimed in claim 1, wherein the gravity separator is substantially a vibrating screen or a rotary sieve.

4. The system as claimed in claim 1, wherein the system further comprising at least one intermediate conduit interconnecting said dredge vessel with the barge for transferring total heavy minerals.

5. The system as claimed in claim 1, wherein the dewatering unit accomplishes removal of water from the total heavy minerals by sun drying or heating or dehydrating equipment.

6. The system as claimed in claim 1, wherein the density separator is substantially a hydro-sizer or a cyclonic separator or an air density separator or a liquid density separator.

7. The system as claimed in claim 1, wherein the dewatering unit, magnetic separators, electro-magnetic separators, and density separators included in the barge can be arranged and configured in any sequence based on the requirement of user.

8. A method for off shore mining comprising the steps of:

dredging and procuring sediments and debris from water bodies;

excluding oversized particles and obtaining of finer particles from sediments and debris by gravity separators;

extracting total heavy minerals from finer particles of sediments and debris by spiral classifiers;

dewatering the total heavy minerals to expel water absorbed by the total heavy minerals;

separating desired minerals from total heavy minerals based; and tailing of wastes, leftover after extraction and separation of desired minerals, back into water bodies.

9. A method for off shore mining as claimed in claim 8, wherein separating desired minerals from total heavy minerals is based on at least one predetermined properties selected from a group comprising magnetic properties, electro-magnetic properties, and density.

* * * * *